United States Patent [19]

Piesik

[11] Patent Number: 4,545,284

[45] Date of Patent: Oct. 8, 1985

[54] PROTECTION DEVICE FOR ROCKET LAUNCHER RAIL

[75] Inventor: Edward T. Piesik, Pomona, Calif.

[73] Assignee: General Dynamics Pomona Division, Pomona, Calif.

[21] Appl. No.: 489,876

[22] Filed: Apr. 29, 1983

[51] Int. Cl.[4] ..... F41F 3/04; F41F 7/00

[52] U.S. Cl. ..... 89/1.819; 89/1.8

[58] Field of Search ..... 89/1.819, 1.8, 1.817, 89/1.818, 1.812

[56] References Cited

U.S. PATENT DOCUMENTS

| | | | |
|---|---|---|---|
| 2,445,423 | 7/1948 | Eastman | 89/1.8 X |
| 2,780,143 | 2/1957 | Graham | 89/1.817 |
| 2,816,483 | 12/1957 | Johnston | 89/1.817 |
| 3,052,303 | 9/1962 | Lapp | 89/1.812 X |
| 3,076,385 | 2/1963 | Bornhoft | 89/1.819 X |
| 4,044,648 | 8/1977 | Piesik | 89/1.8 |
| 4,336,740 | 6/1982 | Leigh et al. | 89/1.806 |
| 4,423,661 | 1/1984 | Sheldon | 89/1.819 |

*Primary Examiner*—David H. Brown

*Attorney, Agent, or Firm*—Henry M. Bissell; Edward B. Johnson

[57] ABSTRACT

Apparatus for preventing a missile's rocket exhaust gases from contacting and adversely affecting, such as by overheating, the launch rails from which a missile may be launched. Such apparatus includes an angled member having first and second leg portions, the end of the first leg portion being pivotably secured to the rail. A member having an angled surface is mounted to the second leg portion. Prior to the launching of said missile, the apparatus is in a first operative position such that it is out of contact with said launch rail. When the exhaust gases are emitted from said missile, a portion of the exhaust is incident upon the angled surface which causes the apparatus to rotatably pivot into contact with the launch rail, whereby portions of two surfaces of the launch rail are protected from the exhaust. In alternative arrangements, springs or counterweights are provided to hold the protective apparatus open to facilitate loading of a missile on the launch rails while permitting the apparatus to close around the rails when the missile is being launched. Other arrangements provide for translation as well as rotation of a pair of angled members in a clam shell configuration for protection of particularly shaped launch rails.

19 Claims, 11 Drawing Figures

PROTECTION DEVICE FOR ROCKET LAUNCHER RAIL

BACKGROUND OF THE INVENTION

1. Field of the Invention

The present invention relates to missile launching systems and, more particularly, to arrangements for preventing missile exhaust gases from contacting and possibly damaging missile support rails during launching of the missile.

2. Description of the Prior Art

In the firing of tactical missiles on shipboard, and possibly in other military applications, each missile in turn is supported by a pair of support arms by means of launch rails, usually two in number, which engage corresponding shoes mounted on the missiles. The missile hangs in position from the rails by means of this support arrangement and, when the missile is fired, it accelerates rapidly, the shoes disengage the rails and the missile is released. However, during its initial acceleration phase, the wash of the hot rocket exhaust engulfs the launch rail. The period of engulfment, particularly considering the extremely high temperature of the missile exhaust, is sufficient, even though the acceleration of the missile is very rapid, to damage the launch rail, particularly over a period of repetitive launchings. Other undesirable impingement effects include the deposition of solid or liquid particles from the exhaust, ablation, and pressure loading.

The prior art contains various examples of directing or deflecting exhaust gases from launch arrangements to avoid damage to a launch facility or for other purposes. However, such arrangements as are known do not relate to rail-launched missile facilities. U.S. Pat. No. 2,445,423 of Eastman discloses a device for conducting gases from an ignited rocket through an exhaust tube into an exhaust manifold which in turn conducts the blast of burning gases away to a place where they will do no damage. My own prior U.S. Pat. No. 4,044,648 discloses apparatus of a similar nature that controls the flow of exhaust gases between a plurality of rocket launch chambers and a common manifold for ducting rocket exhaust gases to a discharging location. Flow control doors are associated with each chamber, the exhaust gases emitted from a fired rocket being prevented from circulating into non-firing rocket chambers. U.S. Pat. No. 2,780,143 of Graham discloses a tandem rocket launcher having means for deflecting gases emitted from the exhaust of a forward rocket from impinging upon a rearward rocket, the rockets being mounted in tandem within the launcher. U.S. Pat. No. 2,816,483 of Johnston discloses a streamlined housing which surrounds a rocket launching tube mounted to an airplane, the housing being moved upon the firing of a rocket from the tube by the exhaust gas of the rocket to a position which provides a clear course for the forward movement of the rocket. U.S. Pat. No. 3,052,303 of Lapp discloses a mechanically operated fire detector wherein inadvertent ignition of a rocket propellant produces an exhaust blast to which a valve latching means is responsive, release of the latch causing pressurized water to be directed onto the rocket and thus extinguishing the ignited propellant. U.S. Pat. No. 3,076,385 of Bornhoft discloses a locking mechanism which locks a rocket to a frame, the exhaust gases from the rocket firing forcing the latch mechanism open to release the missile for launching. U.S. Pat. No. 4,336,740 to Leigh et al discloses a rocket launcher and includes a positive release mechanism actuated by the rocket thruster. The release mechanism is located in a manner so that it is not subjected to the exhaust gases from the fired missile. However, none of these prior art references teach or suggest the concept of the present invention which is to provide protection for rocket launching rails.

SUMMARY OF THE INVENTION

In brief, arrangements in accordance with the present invention involve one or a plurality of launch rails for supporting an associated missile and permitting the launch of the missile therefrom. Upon ignition of the missile rocket, the missile accelerates, slides off and past the launch rails, and heads toward the target.

In one particular arrangement in accordance with the invention, a protective shield or flap is attached to the launch rail, the shield being driven by the exhaust plume from a launched rocket to rotate into a protective (closed) position over the rail. When not activated by the exhaust plume, the device is maintained in an open position that does not interfere with the loading or movement of the rocket on the launch rail. Additional shields can be added along the length of the rail if desired. The shield comprises an angled, L-shaped member. One portion of the member has a spring loaded pivot device which is mounted to the rail or launcher arm. The other portion of the L-shaped member has an angled surface element affixed thereto. The exhaust gases from the rocket impinge on the angled surface and the pressure on the surface produces a moment that rotates the shield into place over the rail, protecting the rail from the effects of the exhaust plume. The rotational moment exceeds the spring torque which holds the shield in the normally open position. Additional independently actuated shields can be provided both for longer rails and for the portion of a rail behind the rocket.

Alternative arrangements in accordance with the present invention are provided for achieving similar results with respect to missiles and/or rails having different configurations.

For example, where the device of the present invention is intended for use in a sea environment in which the spring loading the pivot device might be subject to corrosion, a counterweight system can be provided as an alternative to the spring.

In some missile/launch rail configurations, a single L-shaped member may be incapable of providing sufficient clearance for the missile during loading of the missile onto the launch rails. In such a case, an arrangement comprising two L-shaped members, one on either side of the launch rail, which work together as a "clam shell" to protect the rail may be utilized.

For other configurations, even the clam shell members may interfere with the missile during loading. In such cases, each side of the clam shell device may be rotated away from its protective position and also translated upward by the counterweight mechanism which is provided. Upon rocket motor ignition, the exhaust impinges upon the angled surface of each L-shaped member, and the resulting pressure force first translates the member down and then rotates the member over the rail, closing the clam shell device and protecting the rail.

In order to protect the front face of the launch rail from the stagnation heating effects of the exhaust, an additional angled surface, or forward ramp, can be provided for the above-described shield such that the exhaust is deflected from the front face of the rail while at the same time adding additional rotating moment to the shield to force it to the closed position.

Devices in accordance with the present invention protect the surface of a launch rail from the exhaust plume of a launched rocket. Launch rails, especially those near the aft end of the rocket, are protected from the impingement of the rocket exhaust after the rocket is launched, thus significantly reducing the impingement effects of heating, deposition of solid or liquid particles and pressure loading. The shield arrangements of the present invention are relatively simple, easily maintained and replaced, and are self-actuated. Each arrangement requires minimal system modification and does not interfere with the loading or the launch process, thus providing a relatively inexpensive shield for launch rail protection.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
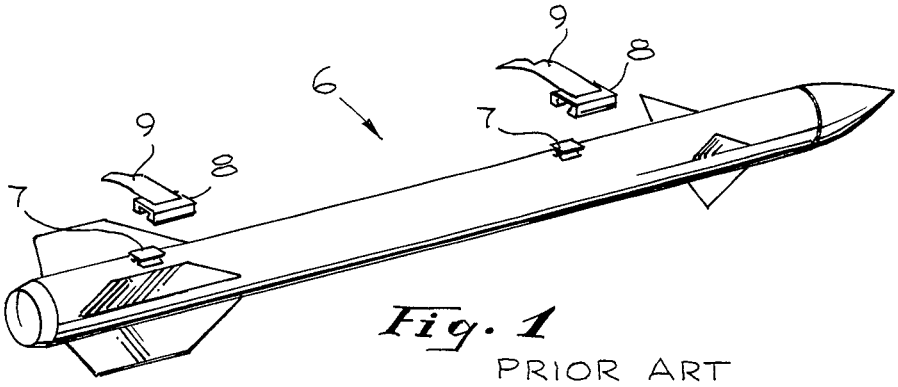
Fig. 1 PRIOR ART
FIG. 1 is a drawing showing a conventional launch rail system for supporting a rocket during launch.

FIG. 1 illustrates a typical system of the prior art for the support and launching of a tactical missile. The missile 6 is shown having a pair of shoes 7 adapted to engage launch rails 8 which are respectively mounted at the outer ends of support arms 9. The launch rails 8 are each typically about one foot long (but may be shorter, or may be even longer than the missile itself) for a missile which is about 15 feet long by one foot in diameter.

Figure 2:
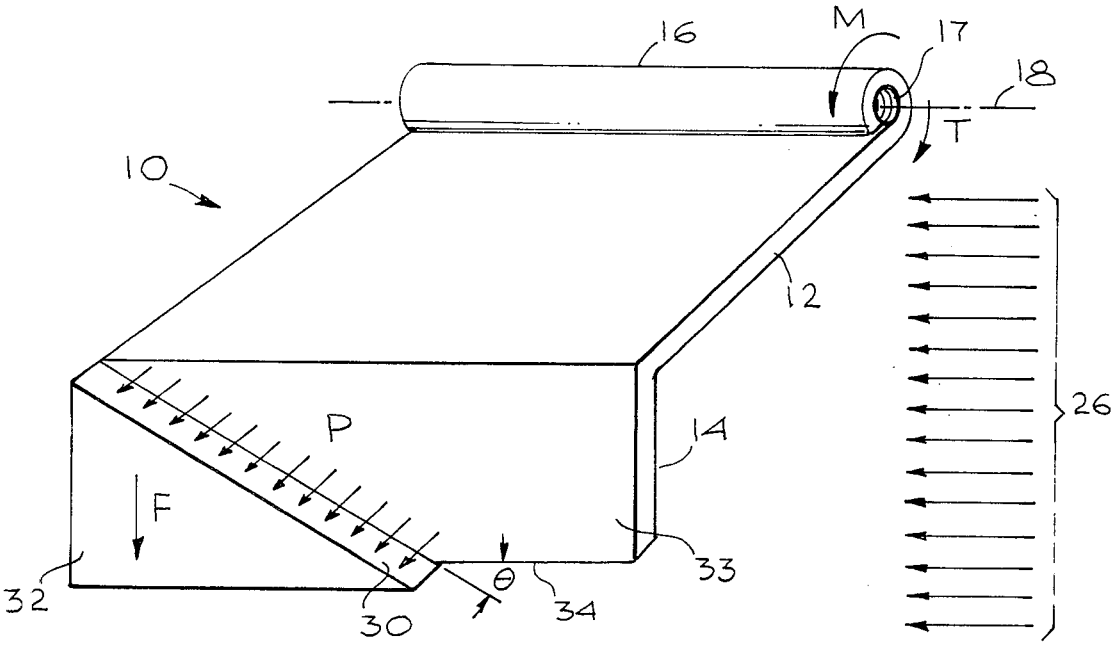
FIG. 2 is a perspective view of a first embodiment of the protective shield of the present invention and illustrates the principles of the shield operation.

Referring now to FIG. 2, a perspective view of the shield, or flap, member 10 of the present invention is illustrated. Angled member 10 comprises, in the preferred embodiment, an L-shaped member having an elongated leg portion 12 and a leg portion 14 which is substantially perpendicular to portion 12. As shown in the figure, portion 12 is longer than portion 14. The distal end of portion 12 terminates in an elongated member 16 which is rotatable about axis 18. A torsional spring 17 is positioned along axis 18 within member 16. Member 16 is preferably a standard spring loaded hinge.

Figure 3:
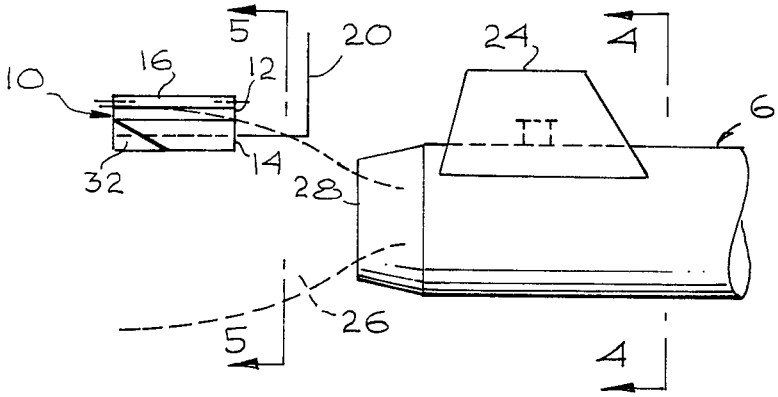
FIG. 3 is an elevation view illustrating rocket exhaust impingement on the shield of FIG. 2.

Referring now to FIGS. 2 and 3, member 10 is mounted to launch rail 20 by member 16. A missile 6 having a plurality of tail sections 24 is illustrated as having just been fired and in the process of being launched from rail 20. Exhaust gases 26 emitted from the missile nozzle 28 impinge upon member 10. In particular, pressure—indicated by reference letter P (FIG. 2)—results from the exhaust gases 26 impinging on the angled surface 30 of a wedge, or triangular, shaped member 32 which is affixed to a corner of surface 33 of portion 14. Surface 30 makes an angle $\theta$ with edge 34 of portion 14 as shown. The pressure P exerted by exhaust gases 26 on the surface 30 results in a moment M directed about the lever arm provided by portion 12 and rotates member 10 into place over the rail 20 as shown in FIG. 5, thus protecting rail surfaces 27 and 29 (shown in FIG. 4) from the effects of exhaust impingement. The moment M is selected to be greater than the spring torque T, which biases member 10 in the normally open position shown in FIG. 4. The angle $\theta$ should be selected such that the angled surface 30 develops a sufficient moment to rotate member 10 to the closed position while minimizing heat transfer to angled surface 30. Typical values for $\theta$ are in the range from about 15° to about 20°.

Figure 4:
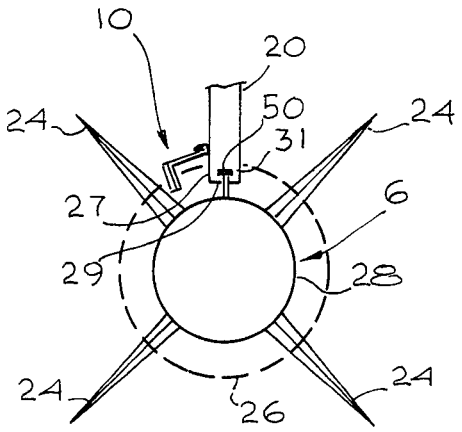
FIG. 4 is an end view of FIG. 3 illustrating the shield in its non-protecting, or open, position.
Figure 5:
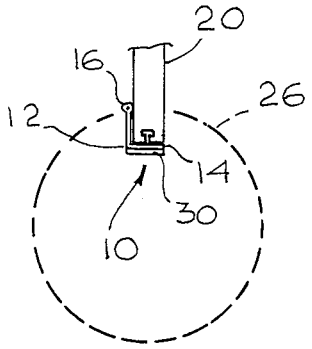
FIG. 5 is an end view view of FIG. 3 illustrating the shield in its protecting, or closed, position.

FIG. 4, an end view from line 4—4 of FIG. 3, shows member 10 in the process of being rotated from its open, or non-protecting, position to its closed, or protecting, position (FIG. 5). As can be seen, member 10 is positioned such that it does not interfere with the normal loading and launch functions of rail 20.

FIG. 5 is a view along line 5—5 of FIG. 3 with member 10 in its protecting position, thereby protecting launch rail 20 from the effects of rocket exhaust impingement.

For the arrangement depicted in FIGS. 2-5, the actuating force F resulting from the impingement of the exhaust gases on the inclined surface 30 and the resultant rotational moment M are developed in accordance with the following equations:

$$F = P \cdot A \cos\theta \quad (1)$$

$$M = F \cdot L \quad (2)$$

where A is the area of the inclined surface 30, L is the length of the elongated leg portion 12 plus one-half the thickness of the wedge 32, P is the pressure of exhaust gas impinging on area A, and $\theta$ is as depicted in FIG. 2.

Figure 6:
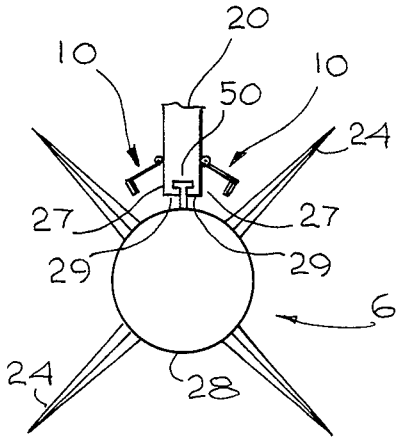
FIG. 6 is an end view of a second embodiment of the shield of the present invention in its non-protecting, or open, position.
Figure 7:
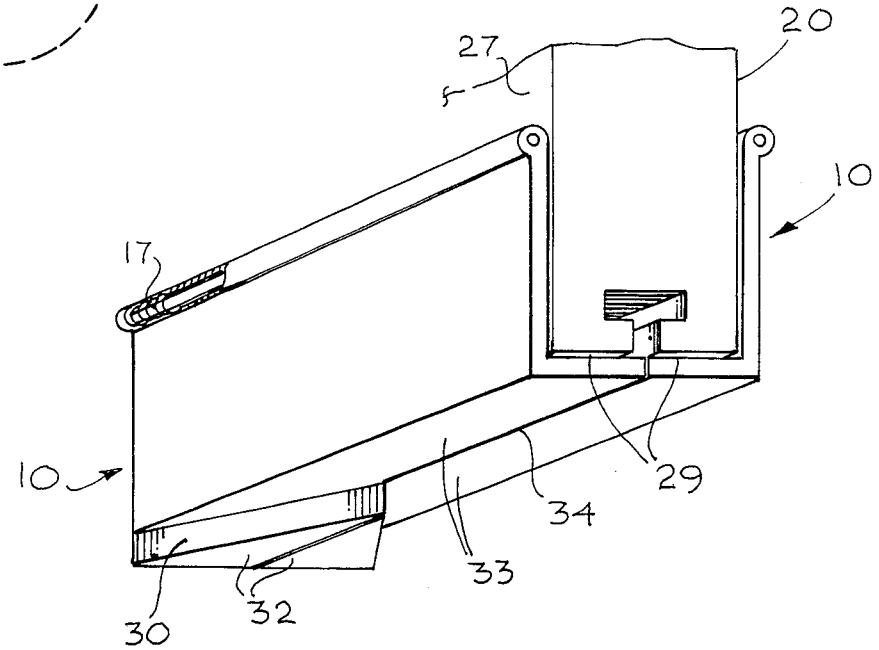
FIG. 7 is a perspective view showing the shield of FIG. 6 in its protecting, or closed, position.

An alternative arrangement in accordance with the present invention is shown in FIG. 6. In this embodiment, a member 10 is positioned on each side of arm 20 so that each member 10 protects one-half of the rail surfaces 27, 29. FIG. 7 shows this embodiment in its closed, clam shell position, protecting the launch rail surfaces.

As shown in FIGS. 4, 6 and 7, member 10 does not interfere with the missile 6 during the loading cycle which generally occurs from the rear of the rail 20. Member 10 is designed to be rotated clear of the missile 6 and appendages thereon when in the open position. Member 10 is mechanically held in the open position during the loading cycle by spring 17 on the pivot axis. Although a pivot axis spring is preferred since it is independent of any other launch rail operations, other mechanical means could be utilized.

Figure 8:
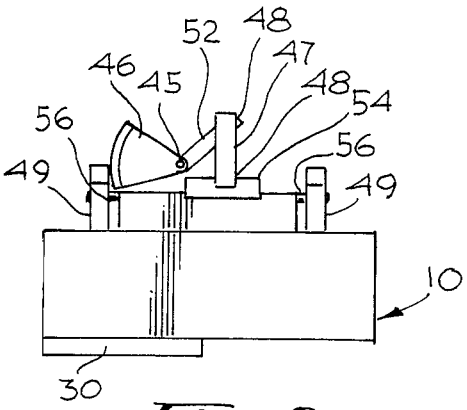
FIG. 8 is an elevation view of an alternative embodiment of the present invention showing a counterweight system as used in place of a torsional spring.
Figure 9:
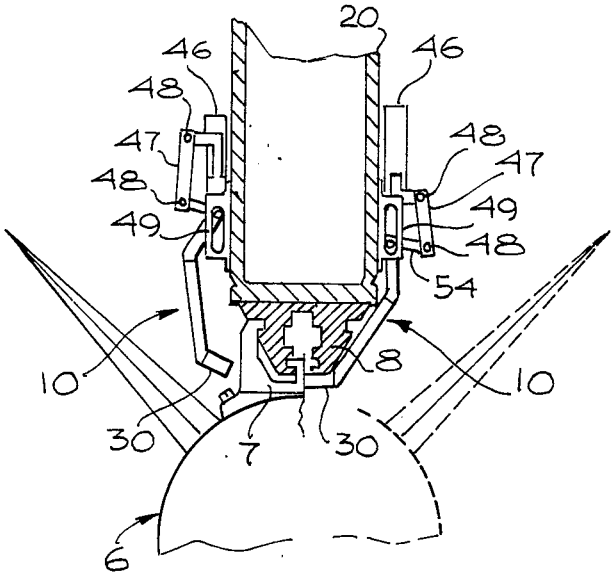
FIG. 9 is an end view of another embodiment of the shield of the present invention, illustrating the shield mechanism in both the open and closed positions and depicting both translational and rotational modes of operation.

One such alternative arrangement comprises a counterweight system as shown in FIGS. 8 and 9. Such a counterweight system does not suffer from the disadvantages of a spring mechanism where the spring loading system is to be used in a sea environment where it would be susceptible to corrosion.

The counterweight system may also be used to further reduce the likelihood of interference of the shields 10 with the missile 6. As shown on the right-hand side of FIG. 9, member 10 is in the protected, or closed, position. Without exhaust impingement on surface 30, the counterweight 46 initially causes the member 10 to rotate in guide 49 and then, by both rotation and translation in guide 49, to move to the unprotected, or open, position which is shown on the left-hand side of FIG. 9. In this arrangement, it is the translation in guide 49 which avoids interference with missile 6 during the loading cycle.

Upon rocket motor ignition, the exhaust gases impinge on surface 30 of member 10 and the resulting pressure forces simultaneously translate and rotate member 10 into its protecting, or closed, position, as shown on the right-hand side of FIG. 9.

The shielding arrangement of FIGS. 8 and 9 is shown comprising a counterweight 46 mounted for rotation about a pivot axis 45 and having an extended lever arm 52 coupled to an actuator link 47. The link 47 is in turn coupled to an offset extension 54 of the shielding member 10. Link 47 is coupled at both ends to its adjacent elements 52, 54 by means of ball joint couplings 48 which allow pivotable movement of the respective coupling members without restriction to a single plane. The member 10 is suspended by means of tabs 56 within slotted mounting brackets or guides 49. By means of this arrangement, as the exhaust gases bear on the angled surface 30 of the member 10, thus overcoming the force of the counterweight 46, the member 10 moves downward (translationally) through the range of movement afforded by the slotted brackets 49 and then pivots toward the launch rail member 8, thereby joining with the other protective member of the depicted clam shell arrangement to encompass the launch rail member 8 and protect it from the missile exhaust.

From a safety point of view, it is desired that a fail-safe operation be provided during a load cycle so that the device does not interfere with the missile in case the pivot springs or counterweights of the protective shield system fail. This fail-safe mechanism would be active only during the load cycle and would be associated with either the rail 20 or on the loading/transfer mechanism. Such a fail-safe device is not a part of the present invention.

As set forth hereinabove, the rail protection member 10 of the present invention intercepts the exhaust from the missile 6 before it reaches the launch rail 20. To increase the longevity and usefulness of member 10, it is preferably coated with an ablative material that will absorb the exhaust impingement heating. The ablative material can also be selected to have the characteristics of preventing deposition of $Al_2O_3$ on member 10. Typical examples of ablative material which can be utilized with the present invention include phenolics and carbons.

Figure 10:
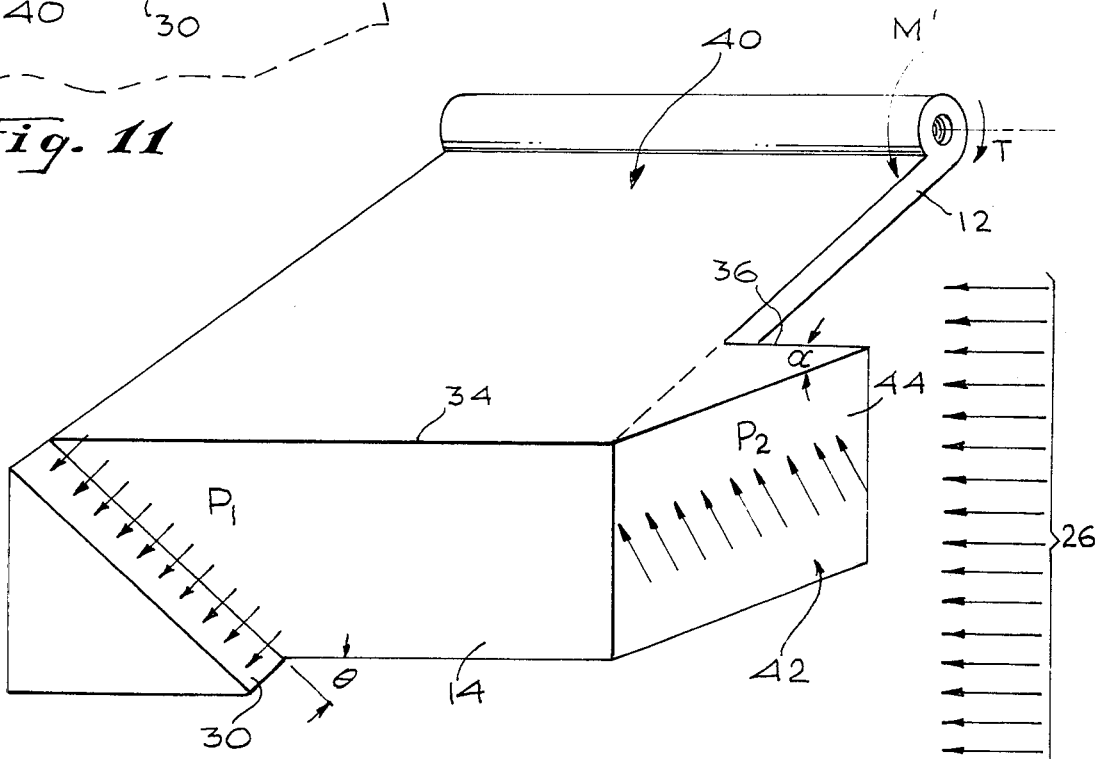
FIG. 10 is a perspective view of still another embodiment of the shield of the present invention, illustrating the principles of shield operation.

The front face 31 of the launch rail 20 is often exposed to the stagnation heating effects of the exhaust 26. FIG. 10 shows an alternative embodiment of the invention which also protects the front face 31 of rail 20. In particular, modified member 40 includes an additional wedge shaped member 42 having an angled surface 44. Surface 44 makes an angle $\alpha$ with edge 36 which is parallel to edge 34 of portion 14. Exhaust gases 26 thus act both on surfaces 30 and 44, the latter pressure being indicated by arrows $P_2$. Member 42 thus deflects the exhaust away from the front surface 31 of rail launcher 20 while at the same time adding additional moment to device 40 to rotate it to the closed position. The angle $\alpha$ is selected so that the exhaust gases are deflected from front face 31. Typical values for $\alpha$ are in the range from about 30° to 50°. It should be noted that the same reference numerals used in both FIGS. 2 and 6 identify like components.

Figure 11:
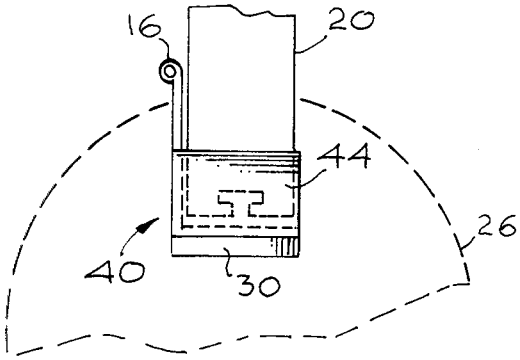
FIG. 11 is an end view illustrating the shield of FIG. 10 in its closed position.

FIG. 11 illustrates an end view of a launch rail 20 after the exhaust 26 has acted upon member 40 to force it to the closed, or protective, position.

It should be noted that, although only one shield member 10 (or 40) has been illustrated as being mounted to rail 20, a series of such shields can be utilized that actuate independently of each other for longer launch rails or for launch rails located behind the missile nozzle which may require protection during launching.

It should be noted that wedge shaped members 32 and 42 and hinge 16 can be separate, joined parts or can be fabricated as an integral part of members 10 and 40.

In operation, member 10 (or 40) or a plurality of such members is secured to the launch rail 20 in a manner so that in its open position it does not interfere with the missile loading process. When the missile thruster is ignited, a portion of the exhaust gases 26 is incident on surface 30 of member 32 (and a portion on surface 44 of member 42). When the pressure P of the gases acting on surface 30 reaches the point where the moment thus provided (force on surface 30 about portion 12) overcomes torque T of spring 17 (calculated to occur shortly after ignition), member 10 is rotated about pivot axis 16 such that surfaces 27 and 29 of rail 20 are protected from the exhaust blast. In the case of the embodiment shown in FIG. 10, surface 31 is also protected. It should be noted that the length of the portions 12 and 14 and their thicknesses are selected to correspond to the appropriate dimensions of the rail 20 to which it is attached for maximum protection for the rail 20. In the FIG. 10 embodiment, the dimensions of surface 44 are also selected to provide for maximum protection of surface 31. As the missile 6 continues its longitudinal movement during the launch, subsequent shield members mounted along the rail are independently actuated to provide substantial coverage along the length of the rail.

Although there have been described above specific arrangements of a launch rail protection device in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

I claim:

1. Apparatus for shielding a launch rail member normally exposed to missile exhaust during launching of a missile, said apparatus comprising:

a pivotable device mounted to one end of said member and having a first operative position such that the device is not shielding said member and a second operative position wherein said device shields portions of said member from said exhaust.

2. The apparatus of claim 1 wherein said device is maintained in said first position by spring means.

3. The apparatus of claim 1 wherein a plurality of said devices are mounted to said launch rail member forward of the missile tail.

4. Apparatus of claim 1 further including a counterweight coupled to the pivotable device to bias the device toward its first operative position.

5. The apparatus of claim 1 comprising a pair of pivotable devices mounted on opposite sides of the launch rail member in a clam shell configuration, both of said devices being movable together into proximity with each other to encompass and shield the launch rail member during missile launch.

6. The apparatus of claim 5 wherein each pivotable device is provided with a counterweight for biasing toward first operative position out of proximity with the launch rail member.

7. The apparatus of claim 6 including a coupling between the counterweight and the pivotable device having means for both translating and pivoting the pivotable device in order to provide greater clearance from the launch rail member when the pivotable device is in the first operative position.

8. The apparatus of claim 1 wherein the device is movable to said second operative position by the missile exhaust acting thereon.

9. The apparatus of claim 8 wherein said device comprises an angled member.

10. The apparatus of claim 9 wherein said angled member comprises first and second leg portions, one of said leg portions being pivotably mounted to said launch rail member.

11. The apparatus of claim 10 wherein said second leg portion includes a first member with an angled surface, said angled surface being located in the path of said missile exhaust.

12. The apparatus of claim 11 wherein said angled surface is oriented in the path of said rocket exhaust to develop a rotational moment from the exhaust gas pressure on said angled surface tending to rotate said device to said second operative position and encompassing said launch rail member.

13. The apparatus of claim 12 wherein said device is mounted to said launch rail member in a manner such that it does not interfere with the loading and launching of the missile when the device is in said first operative position.

14. The apparatus of claim 11 wherein said first leg portion includes a second member having an angled surface, said second member being located in the path of said missile exhaust.

15. The apparatus of claim 14 wherein said first member protects portions of two surfaces of the launch rail member when said device is in said second operative position.

16. The apparatus of claim 15 wherein said second member protects a portion of a third surface of the launch rail member when said device is in said second operative position.

17. Apparatus for shielding a launch rail member normally exposed to missile exhaust during launch of the missile, said apparatus comprising:

an angled member having a first leg portion extending in a first direction and a second leg portion extending in a second direction;

a pivot secured between the launch rail member and one end of said first leg portion and having a spring associated therewith for biasing the angled member toward an open position away from the launch rail member;

the member having an angled surface formed along said second leg portion; said angled member being positioned in the missile exhaust path during launch and oriented to develop a force from the pressure of said exhaust on said angled surface tending to rotate the angled member from the open position to an operative position whereby a portion of said launch rail member is shielded.

18. The apparatus of claim 17 further including a second angled surface extending from said first leg portion, said second angled surface being in the path of said exhaust and oriented to develop additional moment from the exhaust to rotate the angled member about the pivot into said operative position encompassing said launch rail member.

19. The apparatus of claim 18 wherein said second angled surface extends across a forward surface of said launch rail member when said angled member is in said operative position.

* * * * *